US005780791A

United States Patent [19]

Cole

[11] Patent Number: 5,780,791

[45] Date of Patent: Jul. 14, 1998

[54] TIMER FOR CONTROLLING AN APPLIANCE HAVING A PLURALITY OF PAWLS WHICH ROTATE A CAMSTACK

[75] Inventor: Ronald Eugene Cole, Johnson County, Ind.

[73] Assignee: Emerson Electric Co., St. Louis, Mo.

[21] Appl. No.: 806,007

[22] Filed: Feb. 24, 1997

[51] Int. Cl.[6] ..... H01H 43/10

[52] U.S. Cl. ..... 200/38 R; 200/38 B

[58] Field of Search ..... 200/35 R, 38 R, 200/38 B, 38 BA, 38 F, 38 FA, 38 C, 38 CA, 39 R; 74/568 T, 577 R, 578

[56] References Cited

U.S. PATENT DOCUMENTS

| | | | |
|---|---|---|---|
| 3,724,248 | 4/1973 | Obermann . | |
| 3,857,293 | 12/1974 | Godwin et al. | 74/568 T |
| 4,228,690 | 10/1980 | Ring | 74/568 T |
| 4,418,253 | 11/1983 | Okada . | |
| 4,442,326 | 4/1984 | Wagle . | |
| 4,467,664 | 8/1984 | Willigman et al. | 74/568 T |
| 4,538,037 | 8/1985 | Amonett . | |
| 4,611,103 | 9/1986 | Eder et al. | 200/38 B |
| 4,856,096 | 8/1989 | Mahon et al. . | |
| 4,945,196 | 7/1990 | Mahon et al. . | |
| 4,980,523 | 12/1990 | Aigner et al. . | |
| 5,290,978 | 3/1994 | Georgacakis et al. . | |
| 5,637,843 | 6/1997 | Joyce et al. | 200/38 R |

*Primary Examiner*—Khanh Dang
*Attorney, Agent, or Firm*—Mark D. Becker

[57] ABSTRACT

A timer for controlling an appliance includes a camstack which is continuously rotated during a portion of an entire operation cycle of the appliance. The camstack is rotated in either a slow mode of operation or a fast mode of operation. The timer further includes a first slow pawl which is advanced in a first path of movement. Movement of the first slow pawl in the first path of movement causes the camstack to be rotated in the slow mode of operation. The timer also includes a first fast pawl which is advanced in a second path of movement. Movement of the first fast pawl in the second path of movement causes the camstack to be rotated in the fast mode of operation. A method of controlling an appliance is also disclosed.

26 Claims, 7 Drawing Sheets

TIMER FOR CONTROLLING AN APPLIANCE HAVING A PLURALITY OF PAWLS WHICH ROTATE A CAMSTACK

BACKGROUND OF THE INVENTION

The present invention relates generally to timing devices, and more specifically to a timer for controlling an appliance having a plurality of pawls which rotate a camstack.

Appliance timers are commonly used in many household appliances, such as dishwashers, clothes washers, and clothes dryers. The appliance timer controls operations of the appliance by actuating and deactuating switches which start and stop various work operations within the appliance such as a rinse operation in the case of a clothes washer. The switches within the appliance timer are actuated and deactuated as a result of interaction between a number of a cam surfaces defined in a camstack of the appliance timer and a number of cam followers which are respectively associated with the switches.

One common appliance timer is an interval drive timer. This type of appliance timer typically includes a camstack with a number of vertically mounted cylindrical cams driven by a ratchet and drive pawl assembly. Each of the cams includes a cam profile defined in an outer surface thereof which selectively actuates one or more switches thereby controlling various work operations of the appliance. In operation, a drive pawl of the drive assembly indexes the ratchet at predetermined intervals. Accordingly, the ratchet, and thus the cams attached thereto, are in motion for a first period of time. Thereafter, the ratchet is at rest for a second period of time until the next movement thereof by the drive pawl. The ratchet is placed at rest during the second period of time in order to conserve the amount of cam space which is utilized during a given period of time. In particular, it is desirable to control an entire operation cycle of the appliance with one 360° rotation of the camstack.

A drawback associated with placing the ratchet at rest during the second period of time in order to control the entire operation cycle of the appliance with one 360° rotation of the camstack is that the number of points in time which are available for actuating and deactuating switches within the appliance timer is limited. For example, a one-minute interval timer may cause the ratchet and hence the camstack to be in motion for the first five seconds of a given minute, and then at rest for the remaining 55 seconds of the minute. Therefore, switches may only be actuated or deactuated during the first five seconds of each successive minute thereby limiting the ability of the appliance timer to control appliance functions at close intervals. For example, the aforementioned one-minute interval timer could not actuate a switch at the third second of a given minute, and then deactuate the switch at the thirtieth second of the same minute.

One way to overcome the aforementioned drawback is for the appliance timer to include a camstack which is continuously rotated. More specifically, if the camstack of the appliance timer is continuously rotated during a given period of time, switches may be actuated or deactuated at any point during the given period of time thereby increasing the timer's flexibility in the scheduling of timer controlled work operations. To this end, appliance timers have heretofore been designed which include a camstack that (1) may be driven or indexed interruptedly during selected periods of time by a ratchet and drive pawl assembly in a manner similar to an interval drive timer, and (2) may alternatively be continuously driven during selected periods of time by a spur drive assembly. Such appliance timers, known commonly as combination drive timers, provide for increased flexibility in the scheduling of timer controlled work operations, yet also provide for the conservation of cam space. However, combination drive timers are often complex in design and may include components which are particularly susceptible to failure thereby reducing the useful life of the timer. In particular, combination drive timers which have heretofore been designed typically include one or more mechanical clutches which are provided to engage and disengage the ratchet and drive pawl assembly and/or the spur drive assembly from a motor included in the appliance timer. Such mechanical clutches increase the mechanical complexity of the appliance timer, and may fail over time thereby reducing the useful life of the timer.

It is also desirable to quickly rotate the camstack during various periods of time in order to increase the accuracy of the timer. More specifically, the appliance timer's ability to control timing accuracy of the duration of a work operation between the point in time at which the work operation begins and the point in time at which the work operation ends is directly proportional to rotational speed of the camstack. This is true since dimensional errors (e.g. manufacturing errors) and design tolerances associated with the components of the timer (e.g. the cam profiles and the cam followers) remain constant regardless of rotational speed of the camstack. For example, if the location of a drop along the cam profile associated with actuation of a particular work operation is placed 2° further down the cam profile by a manufacturing error, the cam follower will be required to travel the additional 2° prior to dropping, therefore delaying the actuation of the work operation. If the camstack is rotating at a speed of ½° per second, actuation of the work operation will be delayed by four seconds. However, if the camstack is rotating at a speed of 4° per second, actuation of the work operation will be delayed by only one-half second thereby improving the accuracy of the timer.

What is needed therefore is an appliance timer which includes a camstack which is advanced via (1) slow continuous rotation when placed in a first mode of operation in order to increase the flexibility of the timer associated with scheduling timer controlled work operations, (2) fast continuous rotation when placed in a second mode of operation in order to improve the accuracy of the timer, and (3) slow interval rotation when placed in a third mode of operation in order to conserve cam space. What is further needed is an appliance timer that may be switched between the aforementioned first, second, and third mode of operation abruptly, easily, and without the use of a clutch or other mechanical decoupling mechanism in a spur gear train.

SUMMARY OF THE INVENTION

In accordance with a first embodiment of the present invention, there is provided a timer for controlling an appliance. The timer includes a camstack. The timer also includes a plurality of pawls. The pawls cooperate to (1) continuously rotate the camstack when the timer is operated in a first mode of operation, and (2) interruptedly rotate the camstack when the timer is operated in a second mode of operation.

In accordance with a second embodiment of the present invention, there is provided a timer for controlling an appliance. The timer includes a camstack which is continuously rotated during a portion of an entire operation cycle of the appliance. The camstack is rotated in either a slow mode of operation or a fast mode of operation. The timer further includes a first slow pawl which is advanced in a first path of movement. Movement of the first slow pawl in the first path of movement causes the camstack to be rotated in the slow mode of operation. The timer also includes a first fast pawl which is advanced in a second path of movement. Movement of the first fast pawl in the second path of movement causes the camstack to be rotated in the fast mode of operation.

In accordance with a third embodiment of the present invention, there is provided a method of controlling an appliance. The method includes the step of providing a camstack. The method further includes the step of operating a plurality of pawls so as to continuously rotate the camstack when the timer is operating in a first mode of operation. The method also includes the step of operating the plurality of pawls so as to interruptedly rotate the camstack when the timer is operating in a second mode of operation.

In accordance with a fourth embodiment of the present invention, there is provided a timer for controlling an appliance. The timer includes a camstack having a first drive blade and a second drive blade defined therein. The timer also includes a first pawl that is moved so as to engage the first drive blade in order to rotate the camstack during a first period of time. The timer further includes a second pawl that is moved so as to engage the second drive blade in order to rotate the camstack during a second period of time. The camstack is rotated at a first speed by the first pawl during the first period of time. The camstack is rotated at a second speed by the second pawl during the second period of time. The first speed is approximately equal to the second speed.

It is therefore an object of the present invention to provide a new and useful timer for controlling an appliance.

It is a further object of the present invention to provide an improved timer for controlling an appliance.

It is more over an object of the present invention to provide a new and useful method of controlling an appliance.

It is yet further an object of the present invention to provide an improved method of controlling an appliance.

It is also an object of the present invention to provide an appliance timer which includes a camstack which is advanced via (1) slow continuous rotation when placed in a first mode of operation in order to increase the flexibility of the timer associated with scheduling timer controlled work operations, (2) fast continuous rotation when placed in a second mode of operation in order to improve the accuracy of the timer, and (3) slow interval or interrupted rotation when placed in a third mode of operation in order to conserve cam space.

It is moreover an object of the present invention to provide an appliance timer that may be switched between the a first, second, and third mode of operation abruptly, easily, and without the use of a clutch or other mechanical decoupling mechanism.

It is further another object of the present invention to provide a timer for controlling an appliance which (1) has an increased number of points in time at which switches may be actuated or deactuated relative to appliance timers which have heretofore been designed, (2) achieves high timing accuracy of the various work operations within the timer, and (3) controls the entire cycle of the appliance with one 360° rotation of a single camstack.

The above and other objects, features, and advantages of the present invention will become apparent from the following description and the attached drawings.

DETAILED DESCRIPTION OF THE INVENTION

Figure 1:
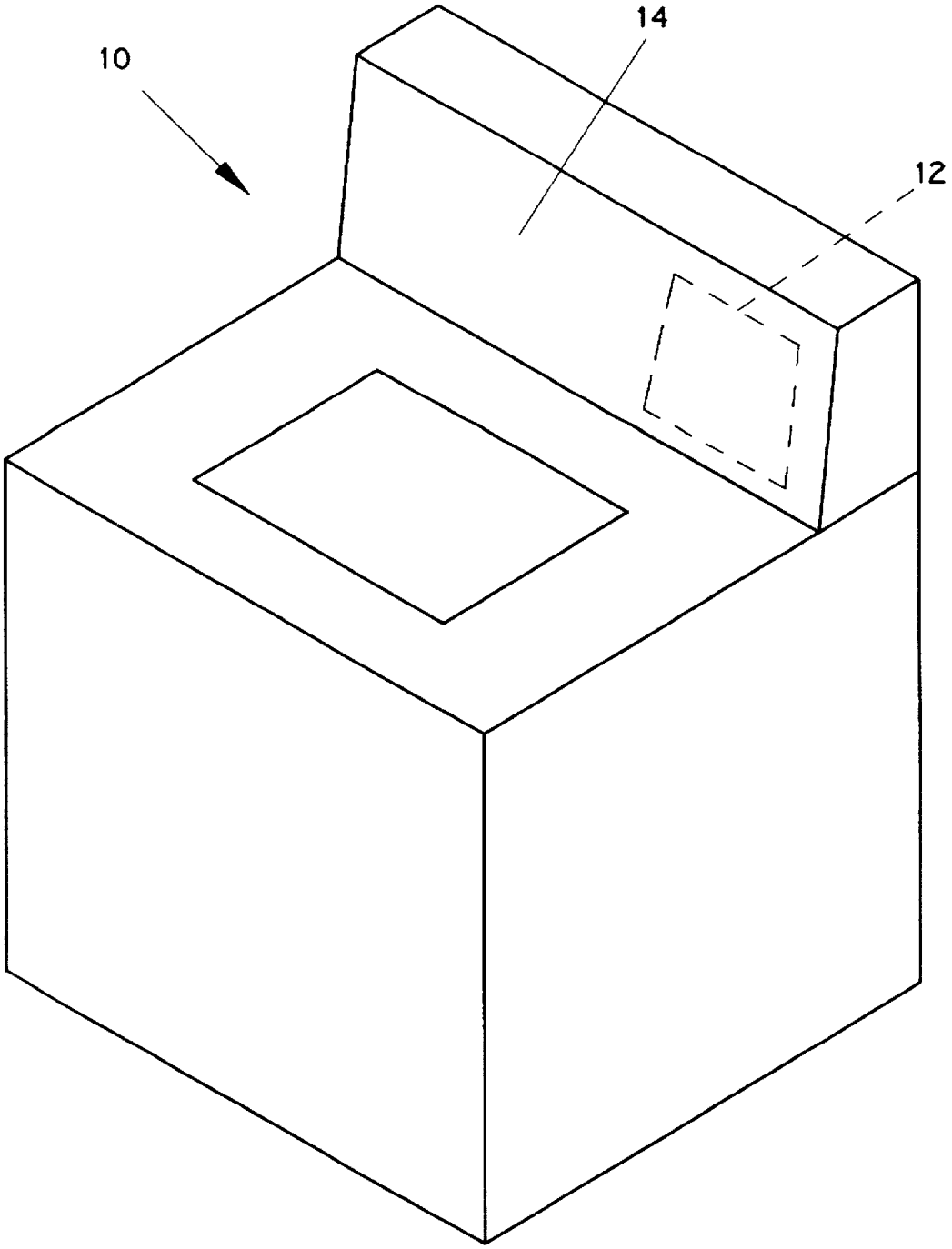
FIG. 1 is a perspective view of an appliance which includes an appliance timer which incorporates the features of the present invention therein.
Figure 2:
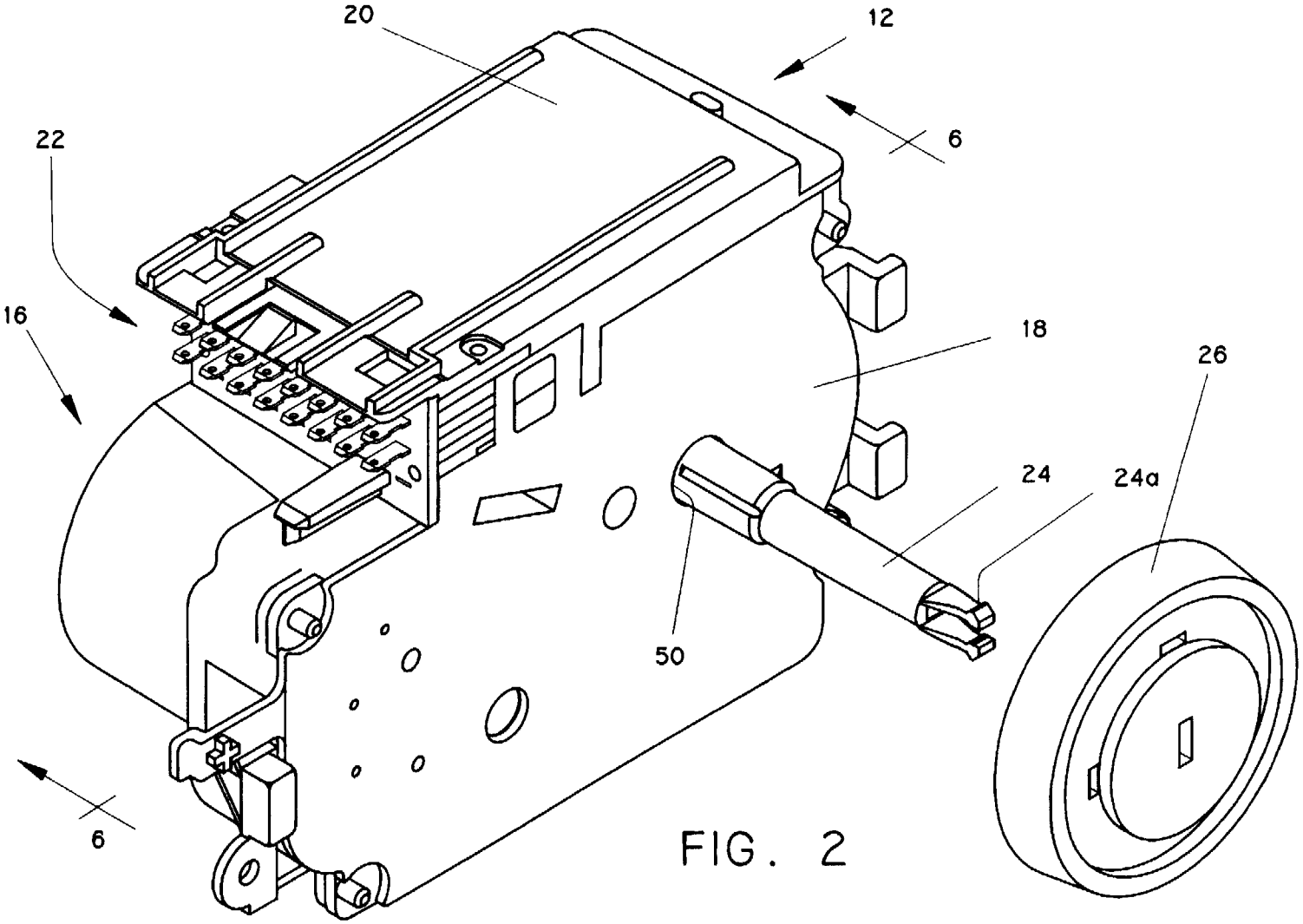
FIG. 2 is a perspective view of the appliance timer of the appliance of FIG. 1.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown an appliance 10 such as clothes washing machine, a dishwasher, or a clothes drying machine. The appliance 10 includes an appliance timer 12. The appliance timer 12 is secured to a console 14 of the appliance 10.

The appliance timer 12 controls various operation sub-cycles which are included in an entire operation cycle of the appliance. What is meant herein by the term "operation sub-cycle" is an individual work operation associated with a given appliance 10. Examples of operation sub-cycles include agitation, washing, spinning, drying, dispensing detergent or fabric softener, hot water filling, cold water filling, and water draining. Moreover, what is meant herein by the term "entire operation cycle" is a routine which includes all of the operation sub-cycles associated with the operation of a particular type of appliance 10. An example of an entire operation cycle is the operation of a clothes washing machine from the time between when an operator activates the appliance timer 12 in order to initiate the first operation sub-cycle (e.g. hot/cold water filling in the case of a clothes washing machine) until the completion of the last operation sub-cycle (e.g. spinning in the case of the clothes washing machine). It should be appreciated that while a single operation sub-cycle (e.g. spinning) may be a few minutes in duration, an entire operation cycle may take 45–60 minutes to complete as in the case of a clothes washing machine.

Referring now to FIGS. 2–6, there is shown the appliance timer 12 in more detail. The appliance timer 12 includes a housing 16, a side plate 18, a top plate 20, an output terminal assembly 22, a control shaft 24, and a knob 26. An operator of the appliance 10 may set the appliance timer 12 to a desired setting by manipulating the knob 26. In particular, the operator of the appliance 10 may push the knob 26 inwardly and thereafter rotate the knob 26 in order to set the appliance timer 12 to a desired setting.

The appliance timer 12 further includes a camstack 30, a pair of slow pawls 32, 34, a pair of fast pawls 36, 38, and a pawl retainer 40. As shall be discussed in more detail below, the slow pawls 32, 34 and the fast pawls 36, 38 cooperate in order to provided for interrupted rotation or continuous rotation of the camstack 30. What is meant herein by the terms "interrupted rotation", "interruptedly rotated", and "interval rotation" is a periodic, intermittent advancement of the camstack 30 in which the camstack 30 is advanced during a first period of time, but then placed at rest (i.e. not advanced) during a second period of time. For example, if the camstack 30 is interruptedly rotated during a given three-minute period, the camstack 30 is advanced for the first 45 seconds, placed at rest for the next 15 seconds, advanced for the next 45 seconds, placed at rest for the next 15 seconds, advanced for the next 45 seconds, and then placed at rest for the final 15 seconds. Conversely, what is meant herein by the terms "continuous rotation", "continuously rotated", and "continuously rotate" is an advancement of the camstack 30 in which the camstack 30 is uninterruptedly in motion for a period of time thereby preventing the camstack 30 from being placed at rest. For example, if the camstack is continuously rotated during a given three-minute period, the camstack 30 is advanced for the entire three-minute period and is not placed at rest at any point in time within the three-minute period.

Figure 3:
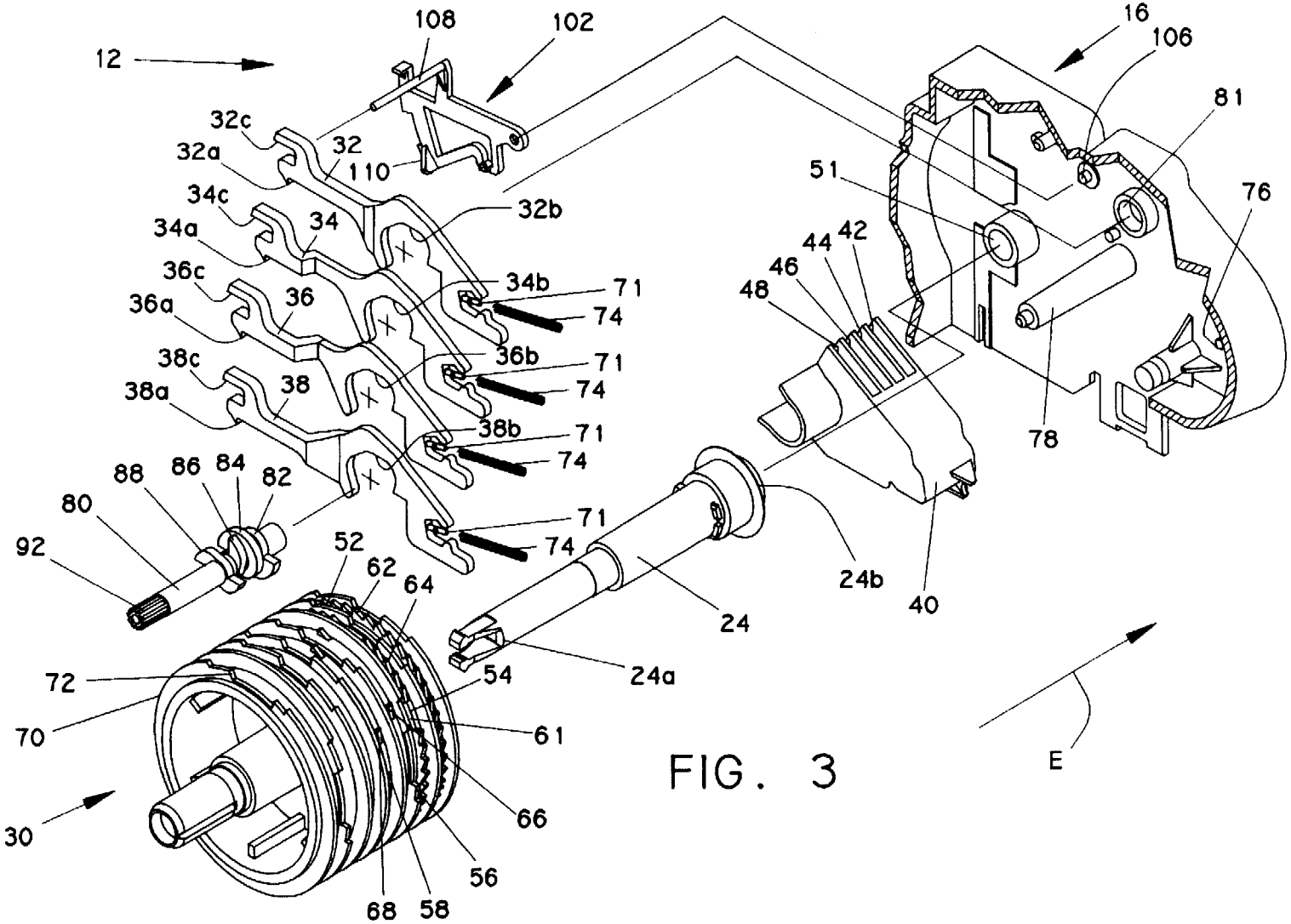
FIG. 3 is an exploded perspective view of a portion of the appliance timer of FIG. 2, with the appliance timer having been rotated 180° about the control shaft 24 for clarity of description.
Figure 4:
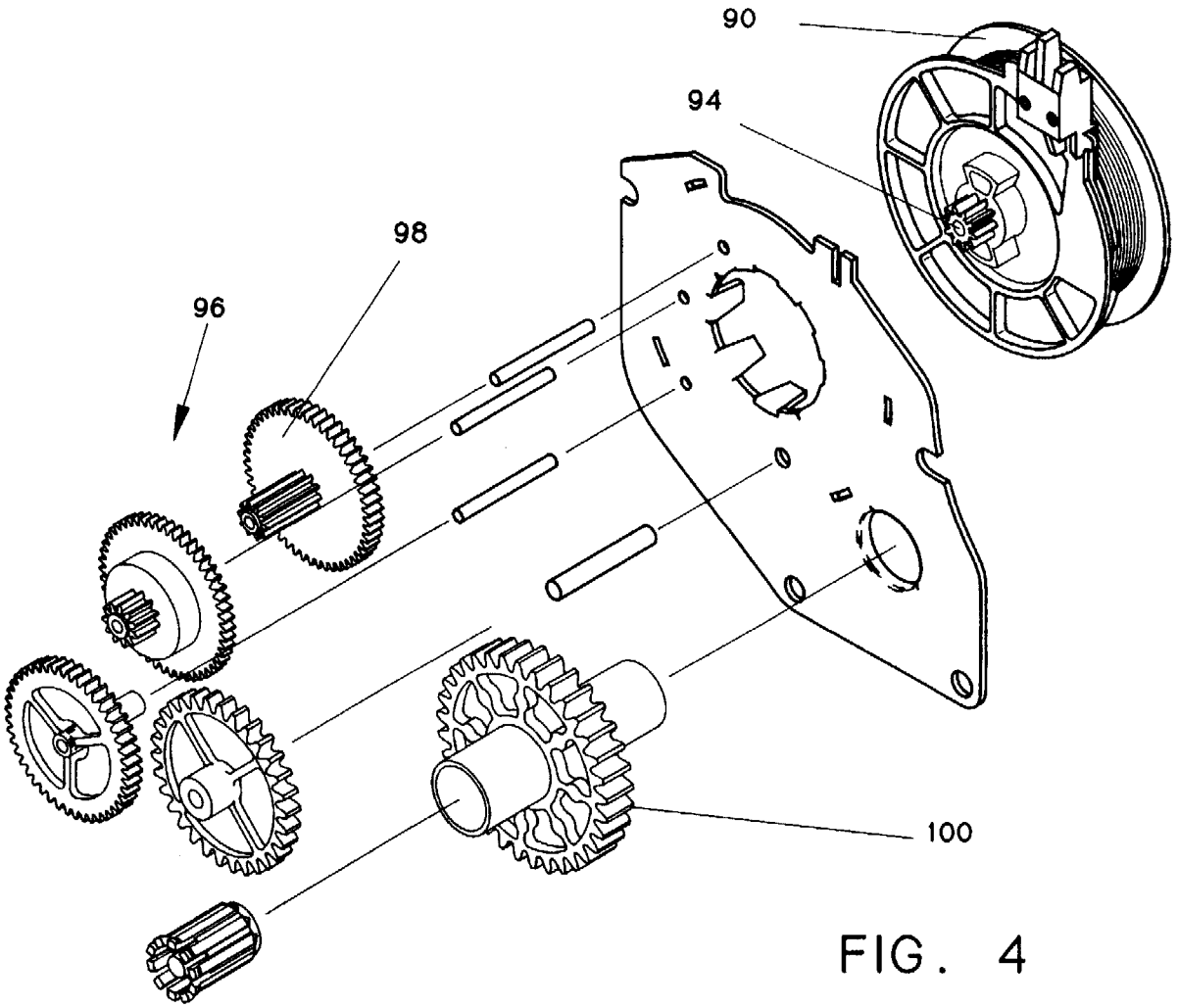
FIG. 4 is an exploded perspective view of the motor and the gear train of the appliance timer of FIG. 2.

The camstack 30 is secured to the control shaft 24. The control shaft 24 includes a protruding end 24*a* and a beveled end 24*b*. The protruding end 24*a* protrudes from an aperture 50 defined in the side plate 18 of the appliance timer 10 in order to be coupled to the knob 26 (see FIG. 2). The beveled end 24*b* of the control shaft 24 is received into an opening 51 defined in the housing 16 as shown in FIG. 3.

Figure 6:
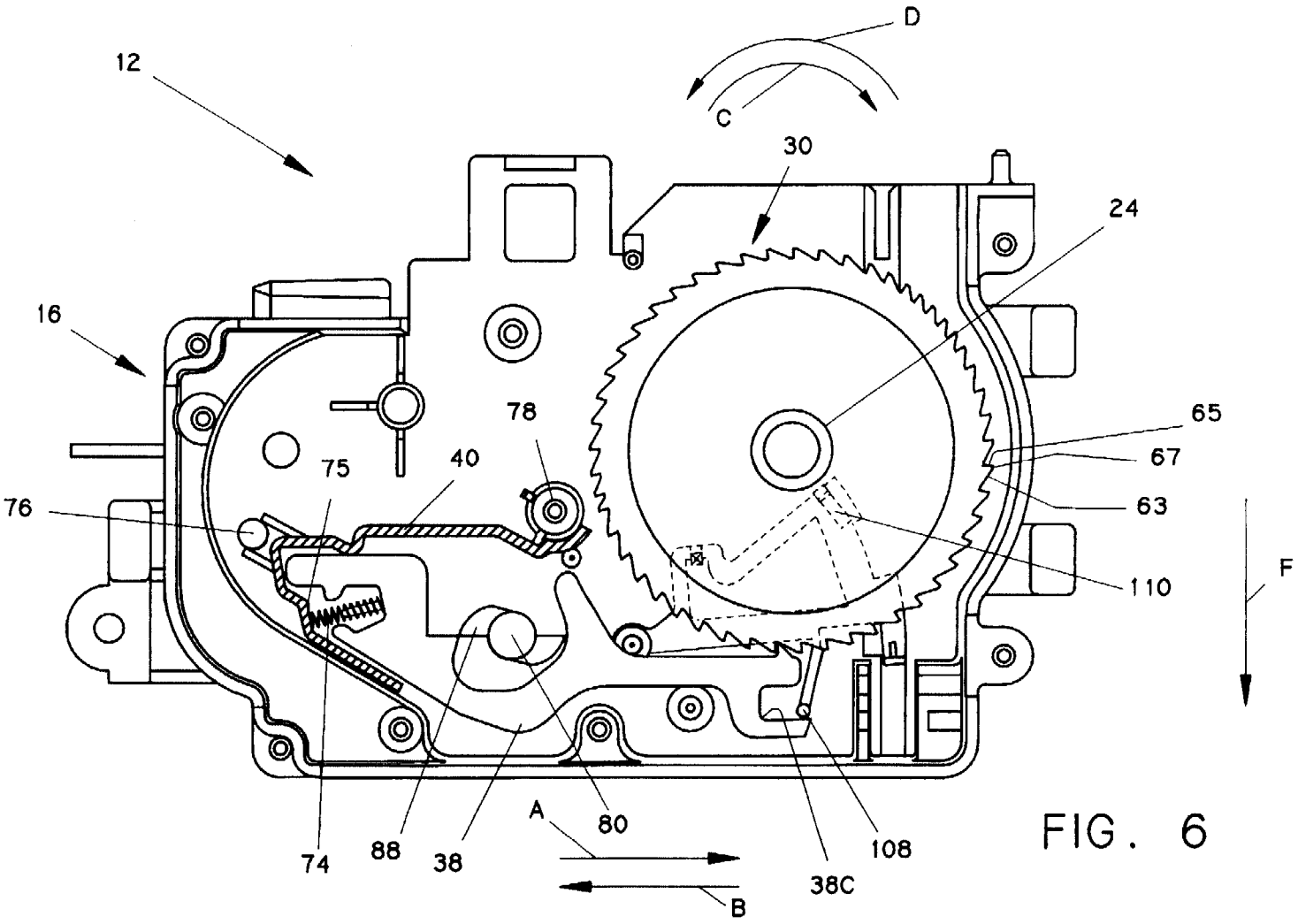
FIG. 6 is a cross-sectional view taken along the line 6—6 of FIG. 2, as viewed in the direction of the arrows.

The camstack 30 includes a number of drive blades 52, 54, 56, 58. As shown in FIG. 3, each of the drive blades 52, 54, 56, 58 has defined therein a group of ratchet teeth 62, 64, 66, 68, respectively. Each of the ratchet teeth 62, 64, 66, 68 includes an inclined surface 63 and an engagement surface 65 (see FIG. 6). The point at which the inclined surface 63 intersects the engagement surface 65 defines an engagement point 67 as shown in FIG. 6. As shall be discussed in more detail below, the size and placement of the ratchet teeth 62, 64, 66, 68 along the drive blades 52, 54, 56, 58, respectively, may be altered in order to switch the appliance timer 12 between a number of modes of operation.

Moreover, the camstack 30 includes a number of program blades 70. The program blades 70 have a number of actuation slots 72 defined therein. The drive blades 52, 54, 56, 58 are non-rotatably coupled to each of the program blades 70. More specifically, rotation of any of the drive blades 52, 54, 56, 58 causes rotation of each of the program blades 70.

Figure 5:
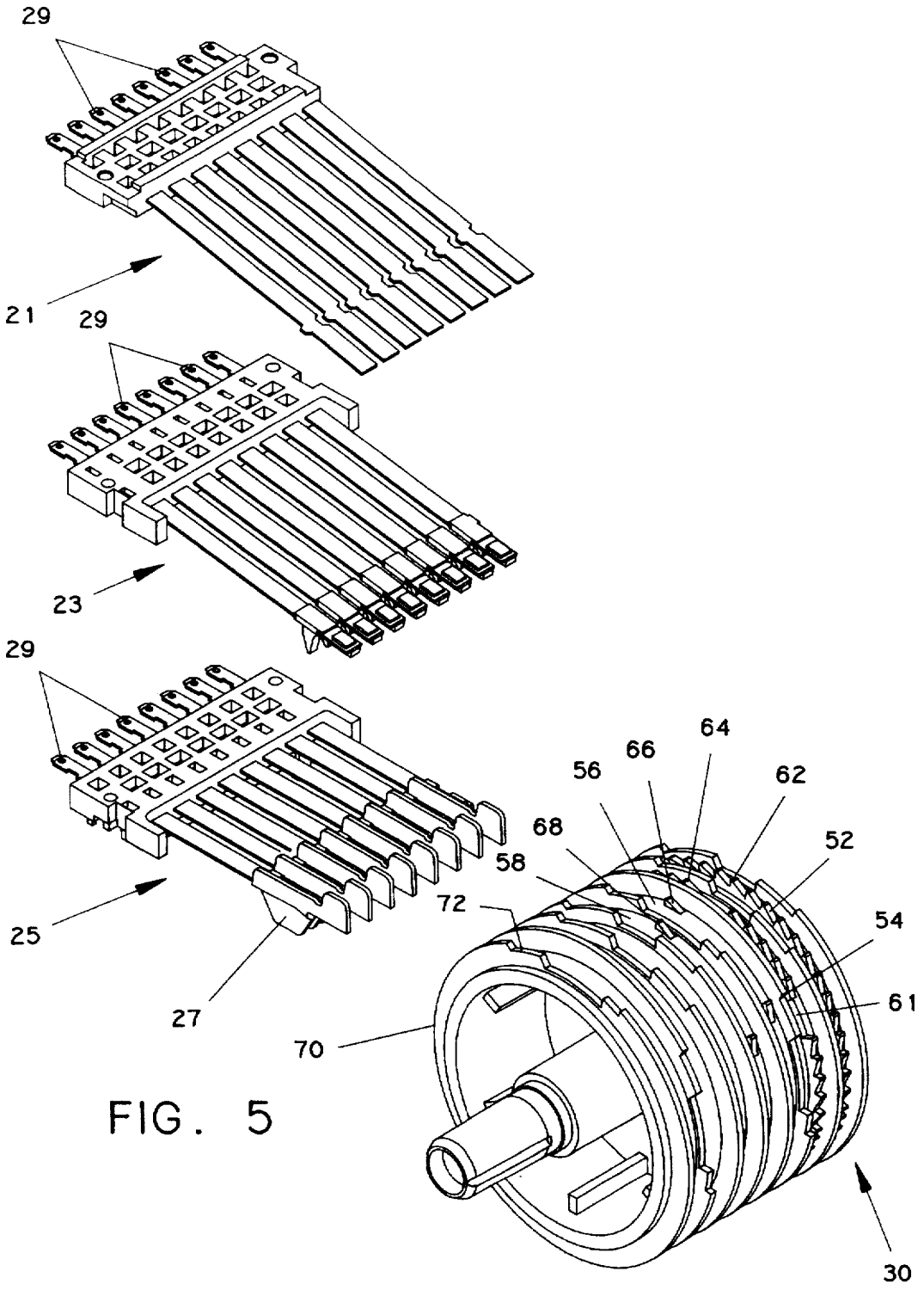
FIG. 5 is an exploded perspective view showing the relationship between the output terminal assembly and the camstack of the appliance timer of FIG. 2.

The program blades 70 of the camstack 30 are used to selectively generate control signals on the output terminal assembly 22. More specifically, the output terminal assembly 22 includes a number of groups of switching blades 21, 23, 25 as shown in FIG. 5. Each of the switching blades 25 includes a cam follower 27. Each of the cam followers 27 is received into a respective actuation slot 72 of a program blade 70 during rotation of the camstack 30 thereby causing the switching blades 21, 23, 25 to be selectively positioned (i.e. closed) to produce an output signal on an output terminal 29 associated with each of the switching blades 21, 23, 25. It should be appreciated that the location and size of each of the actuation slots 72 may be altered in order to produce an output signal on a desired output terminal 29.

A first end of each of the pawls 32, 34, 36, 38 includes a barb 32*a*, 34*a*, 36*a*, 38*a*, respectively (see FIG. 3). The barbs 32*a*, 34*a*, 36*a*, 38*a* selectively engage the ratchet teeth 62, 64, 66, 68, respectively, in order to rotate the camstack 30. More specifically, the barb 32*a* of the pawl 32 cooperates with the engagement surface 65 of the ratchet teeth 62 in order to drive the drive blade 52 and hence the program blades 70, whereas the barb 34*a* of the pawl 34 cooperates with the engagement surface 65 of the ratchet teeth 64 in order to drive the drive blade 54 and hence the program blades 70. Similarly, the barb 36*a* of the pawl 36 cooperates with the engagement surface 65 of the ratchet teeth 66 in order to drive the drive blade 56 and hence the program blades 70, whereas the barb 38*a* of the pawl 38 cooperates with the engagement surface 65 of the ratchet teeth 68 in order to drive the drive blade 58 and hence the program blades 70.

The pawls 32, 34, 36, 38 are secured to the housing 16 via a pawl retainer 40. More specifically, the pawls 32, 34, 36, 38 are movably coupled to the pawl retainer 40 which is in turn non-movably secured to the housing 16 via a pair of posts 76 and 78. The pawl retainer 40 includes a number of retaining slots 42, 44, 46, 48. A second end of each of the pawls 32, 34, 36, 38 is respectively disposed in the retaining slots 42, 44, 46, 48.

Each of the pawls 32, 34, 36, 38 includes a post 71 as shown in FIG. 3. A spring 74 is disposed on each of the posts 71. The springs 74 cooperate with an inner surface 75 (see FIG. 6) defined in each of the retaining slots 42, 44, 46, 48 in order to urge the pawls 32, 34, 36, 38 in the general direction of arrow A of FIG. 6. As the pawls 32, 34, 36, 38 are urged in the general direction of arrow A of FIG. 6, the barbs 32*a*, 34*a*, 36*a*, 38*a* are urged into contact with the ratchet teeth 62, 64, 66, 68, respectively.

Movement of the pawls 32, 34, 36, 38 is caused by a drive shaft 80. More specifically, a first end of the drive shaft 80 is rotatably secured within an aperture 81 defined in the housing 16 (see FIG. 3). The drive shaft 80 includes a number of drive cams 82, 84, 86, 88 which are respectively positioned within a cam aperture 32*b*, 34*b*, 36*b*, 38*b* defined in each of the pawls 32, 34, 36, 38. Each of the cam apertures 32*b*, 34*b*, 36*b*, 38*b* defines an open aperture. What is meant herein by the term "open aperture" is an opening that is defined in the circumference of the cam aperture 32*b*, 34*b*, 36*b*, 38*b* as shown in FIG. 3. The use of such open apertures provides the pawls 32, 34, 36, 38 with advantages over pawls which have heretofore been designed. In particular, the use of open apertures in the design of the pawls 32, 34, 36, 38 allows the drive cams to be easily received into the cam apertures 32*b*, 34*b*, 36*b*, 38*b* thereby permitting the appliance timer 12 to be more easily assembled.

Rotation of the drive shaft 80 causes the drive cams 82, 84, 86, 88 to rotate within the cam apertures 32*b*, 34*b*, 36*b*, 38*b*, respectively, which causes the pawls 32, 34, 36, 38 to be advanced through a respective path of movement. The drive shaft 80 is operatively coupled to a motor 90 (see FIG. 4) thereby providing for rotation thereof. In particular, a second end of the drive shaft 80 includes a pinion 92 which is coupled to an output gear 94 of the motor 90 via a gear train 96 (see FIG. 4). More specifically, the output gear 94 of the motor 90 is meshingly engaged with an input gear 98 of the gear train 96, whereas an output gear 100 of the gear train 96 is meshingly engaged with the pinion 92. The motor 90 and the gear train 96 cooperate to rotate the pinion 92 and hence the drive shaft 80 at a constant speed. For example, the drive shaft 80 may be rotated at one revolution-per-minute.

During a single 360° rotation of the drive cam 82, the slow pawl 32 is advanced through one complete stroke thereof. A single stroke of the slow pawl 32 includes a pull segment, a reset segment, and a pursue segment. During the pull segment of the stroke, the slow pawl 32 pulls or otherwise urges a given ratchet tooth 62 in the general direction of arrow C of FIG. 6 thereby rotating the drive blade 52 and hence the program blades 70 in the same direction. Once the slow pawl 32 has pulled the ratchet tooth 62 a predetermined distance, such as 6°, the configurations of the drive cam 82 and the cam aperture **32*b* cause the slow pawl 32 to cease pulling the ratchet tooth 62. More specifically, after the slow pawl 32 has pulled the ratchet tooth 62 the predetermined distance, the slow pawl 32 begins the reset segment of its stroke. In the reset segment of its stroke, the slow pawl 32 is urged in the general direction of arrow A of FIG. 6 thereby advancing the barb 32*a* along the inclined surface 63 of a subsequent ratchet tooth 62. More specifically, the spring 74 causes the barb 32*a* to be advanced along the inclined surface 63 in the general direction of arrow A of FIG. 6**.

Figure 7A:
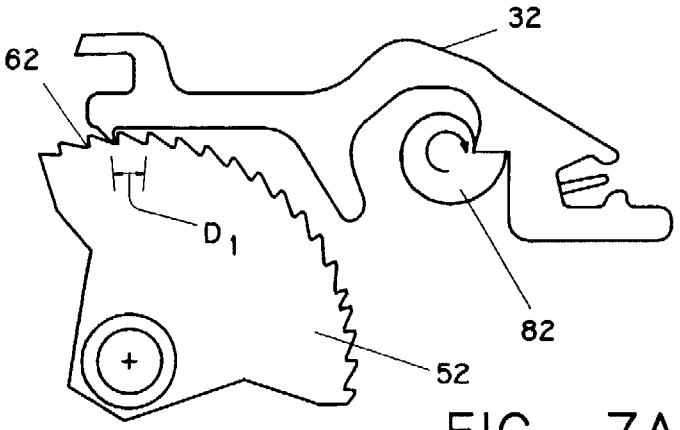
FIGS. 7A–7D are schematic views showing the relationship between the drive pawls and the drive blades of the appliance timer of FIG. 2.

During the reset segment, the barb **32*a* is advanced a distance $D_1$ as shown in FIG. 7A in order to allow the barb 32*a* to engage the engagement surface 65 of the ratchet tooth 62 despite any dimensional errors (e.g. manufacturing errors) and design tolerances that may be associated with the appliance timer 12. For example, if the engagement point 67 of a given ratchet tooth 62 is placed a distance of ½° further down the drive blade 52 by a manufacturing error, the barb 32*a* must be advanced a distance of an additional ½° beyond the engagement point 67. It should be appreciated that the magnitude of the distance $D_1$ may be varied so long as the barb 32*a* is advanced beyond the engagement point 67 of the ratchet tooth 62 despite a given range of dimensional errors and design tolerances that may be associated with a given appliance timer 12. In particular, the barb 32*a* is advanced a distance ($D_1$) of 9° during the reset segment of the stroke of the slow pawl 32. Therefore, if the ratchet teeth 62 defined in the drive blade 52 range in size from 4½° to 6°, the barb 32*a* is advanced a distance of 3° beyond the largest ratchet tooth 62**.

After the slow pawl 32 completes the reset segment of its stroke, the slow pawl 32 begins the pursue segment of its stroke. In the pursue segment of its stroke, the slow pawl 32 is quickly advanced in the general direction of arrow B in FIG. 6. More specifically, when the slow pawl 32 completes the reset segment of its stroke, the configurations of the drive cam 82 and the cam aperture **32*b* then cause the slow pawl 32 and hence the barb 32*a* to be advanced in the general direction of arrow B in FIG. 6 at a speed which is greater in magnitude than the speed at which the slow pawl 32 is advanced during the pull segment of its stroke. The configurations of the drive cam 82 and the cam aperture 32*b* cause the slow pawl 32 to continue to be advanced at the increased speed until the barb 32*a* is urged into contact with the engagement surface 65 of a subsequent ratchet tooth 62. Once urged into contact with the engagement surface 65, the slow pawl 32 and hence the barb 32*a* decreases in speed and begins to pull the ratchet tooth 62. Therefore, the slow pawl 32** is returned to the pull segment of its stroke thereby completing one entire stroke thereof.

Similarly, during a single 360° rotation of the drive cam 84, the slow pawl 34 is advanced through one complete stroke thereof. A single stroke of the slow pawl 34 includes a pull segment, a reset segment, and a pursue segment. During the pull segment of the stroke, the slow pawl 34 pulls or otherwise urges a given ratchet tooth 64 in the general direction of arrow C of FIG. 6, and thereby rotates the drive blade 54 and hence the program blades 70 in the same direction. Once the slow pawl 34 has pulled the given ratchet tooth 64 a predetermined distance, such as 6°, the configurations of the drive cam 84 and the cam aperture **34*b* cause the slow pawl 34 to cease pulling the given ratchet tooth 64. More specifically, after the slow pawl 34 has pulled the given ratchet tooth 64 the predetermined distance, the slow pawl 34 begins the reset segment of its stroke. In the reset segment of its stroke, the slow pawl 34 is urged in the general direction of arrow A of FIG. 6 thereby advancing the barb 34*a* along the inclined surface 63 of a subsequent ratchet tooth 64. More specifically, the spring 74 causes the barb 34*a* to be advanced along the inclined surface 63 in the general direction of arrow A of FIG. 6**.

Figure 7B:
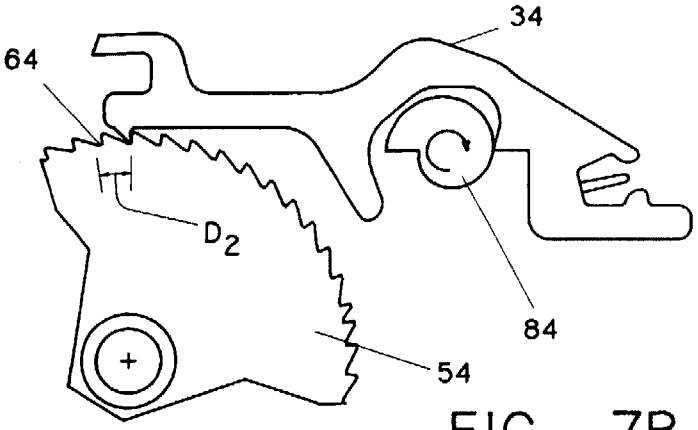

During the reset segment, the barb **34*a* is advanced a distance $D_2$ as shown in FIG. 7B in order to allow the barb 34*a* to engage the engagement surface 65 of the ratchet tooth 64 despite any dimensional errors (e.g. manufacturing errors) and design tolerances that may be associated with the appliance timer 12. It should be appreciated that the distance $D_2$ is equal in magnitude to the distance $D_1$. As with the distance $D_1$, the magnitude of the distance $D_2$ may be varied so long as the barb 34*a* is advanced beyond the engagement point 67 of the ratchet tooth 64 despite a given range of dimensional errors and design tolerances that may be associated with a given appliance timer 12. In particular, the barb 34*a* is advanced a distance ($D_2$) of 9° during the reset segment of the stroke of the slow pawl 34. Therefore, if the ratchet teeth 64 defined in the drive blade 54 range in size from 4½° to 6°, the barb 34*a* is advanced a distance of 3° beyond the largest ratchet tooth 64**.

After the slow pawl 34 completes the reset segment of its stroke, the slow pawl 34 begins the pursue segment of its stroke. In the pursue segment of its stroke, the slow pawl 34 is quickly advanced in the general direction of arrow B in FIG. 6. More specifically, when the slow pawl 34 completes the reset segment of its stroke, the configurations of the drive cam 84 and the cam aperture **34*b* then cause the slow pawl 34 and hence the barb 34*a* to be advanced in the general direction of arrow B in FIG. 6 at a speed which is greater in magnitude than the speed at which the slow pawl 34 is advanced during the pull segment of its stroke. The configurations of the drive cam 84 and the cam aperture 34*b* cause the slow pawl 34 to continue to be advanced at the increased speed until the barb 34*a* is urged into contact with the engagement surface 65 of a subsequent ratchet tooth 64. Once urged into contact with the engagement surface 65, the slow pawl 34 and hence the barb 34*a* decreases in speed and begins to pull the ratchet tooth 64. Therefore, the slow pawl 34** is returned to the pull segment of its stroke thereby completing one entire stroke thereof.

The drive cam 82 and the cam aperture **32*b* cooperate in order to cause the slow pawl 32 to pull a given ratchet tooth 62 during a period of time which is greater than one-half of the time necessary for the drive shaft 80 and hence the drive cam 82 to complete one 360° rotation thereof. For example, if the drive shaft 80 is rotated at a speed of one revolution-per-minute, the slow pawl 32 may pull the ratchet tooth 62** for a period of forty seconds during a given minute.

Similarly, the drive cam 84 and the cam aperture **34*b* cooperate in order to cause the slow pawl 34 to pull a given ratchet tooth 62 during a period of time which is greater than one-half of the time necessary for the drive shaft 80 and hence the drive cam 84 to complete one 360° rotation thereof. For example, if the drive shaft 80 is rotated at a speed of one revolution-per-minute, the slow pawl 34 may pull the ratchet tooth 64** for a period of forty seconds during a given minute.

It should be appreciated that the period of forty seconds during which the slow pawl 34 pulls a given ratchet tooth 64 is different from the period of forty seconds during which the slow pawl 32 pulls a given ratchet tooth 62. In particular, the drive cam 82 and the drive cam 84 are configured to be 180° out-of-phase as shown in FIGS. 7A and 7B. More specifically, the drive cam 82 is configured to begin the pull segment of the stroke of the slow pawl 32 when the slow pawl 34 is nearing the end, but not yet finished, with the pull segment of its stroke, and vice versa. Therefore, the pull segment of the slow pawl 32 overlaps with the pull segment of the slow pawl 34.

For example, the pull segment of each stroke of the slow pawls 32, 34 may be forty seconds in duration, and the sum of the reset and pursue segments of each stroke of the slow pawls 32, 34 may be twenty seconds in duration. Therefore, if the slow pawl 32 begins the pull segment at the beginning of a given minute, and the slow pawl 34 begins its pull segment at the thirtieth second of the same minute, the slow pawl 32 alone pulls the given ratchet tooth 62 for the first thirty seconds, the slow pawl 32 and the slow pawl 34 both pull the given ratchet tooth 62, 64, respectively, for the next ten seconds, and the slow pawl 34 alone pulls the given ratchet tooth 64 for the last twenty seconds (and ten seconds of the next minute). Hence, the drive cams 82, 84 are configured such that at any given time either the slow pawl 32 or the slow pawl 34, or both, is positioned in the pull segment of its respective stroke thereby providing for slow continuous rotation of the camstack 30 during periods of time in which the appliance timer 12 is initiating or terminating a number of operation sub-cycles thereby increasing the flexibility of the appliance timer 12 associated with scheduling timer controlled appliance work operations. Such periods of time in which the slow pawls 32, 34 cooperate in order to provide for slow continuous rotation of the camstack 30 define a slow continuous mode of operation of the appliance timer 12. What is meant herein by the term "slow continuous mode" is a period of time in which the slow pawls 32, 34 cooperate in order to provide for continuous rotation of the camstack 30 at a speed which is lesser in magnitude than the speed at which the fast pawls 36, 38 rotate the camstack 30.

In addition to pulling a given ratchet tooth 62 during the pull segment of its stroke, the slow pawl 32 also functions as a "no-back" pawl during the pull segment of its stroke thereby eliminating the need for a separate no-back pawl which is commonly associated with appliance timers which have heretofore been designed. More specifically, as the slow pawl 34 advances along the inclined surface 65 of the ratchet teeth 64 during the reset segment of its stroke, the bias of the spring 74 urges the ratchet teeth 64 and hence the drive blade 54 in the general direction of arrow D of FIG. 6. However, the force exerted on the engagement surface 65 of the ratchet teeth 62 during movement thereof by the barb **32*a* of the slow pawl 32 is of a greater magnitude than the bias created by the spring 74 thereby preventing the slow pawl 34, or whatever other forces may be present, from rotating the drive blade 54 and hence the program blades 70 in the general direction of arrow D of FIG. 6. Similarly, the slow pawl 34 also functions as a no-back pawl when the slow pawl 34** is positioned in the pull segment of its stroke.

The size of the ratchet teeth 62, 64 determines the distance which the camstack 30 is rotated during one complete stroke of slow pawls 32, 34. For example, the size of the ratchet teeth 62, 64 may be 6° thereby causing the camstack 30 to be rotated a distance of 6° during a single stroke of the slow pawl 32 and/or the slow pawl 34. Therefore, since the slow pawls 32, 34 are operated at a speed of one stroke-per-minute and their strokes overlap, the camstack 30 is rotated at a net speed of six degrees-per-minute when being driven by the slow pawls 32, 34.

The fast pawls 36, 38 cooperate to selectively rotate the camstack 30 at a faster speed relative to the slow pawls 32, 34. Faster rotational speed of the camstack 30 is necessary in order to increase switching accuracy of the appliance timer 12 when actuating or deactuating a critical work operation of the appliance 10. The drive blades 56, 58 may be configured in order to selectively change the speed at which the camstack 30 is rotated. In particular, the ratchet teeth 66, 68 may be selectively positioned on the drive blades 56, 58 at locations which correspond to periods within the operation cycle of the appliance timer 12 when the appliance timer 12 is controlling a critical work operation.

The fast pawls 36, 38 operate essentially the same as the slow pawls 32, 34, except that the fast pawls provide for rotation of the camstack 30 at a faster speed relative to the slow pawls 32, 34 during a certain period of time. A notable exception is that the stroke of the fast pawl 36 and the stroke of the fast pawl 38 do not overlap as do the strokes of the slow pawls 32, 34, but rather the stroke of the fast pawl 36 is abutted with the stroke of the fast pawl 38. As shall be discussed in more detail below, the fast pawls 36, 38 are advanced at a faster speed relative to the slow pawls 32, 34 and also pull larger (7½°) ratchet teeth 66, 68, respectively, thereby eliminating the need for overlapping strokes of the fast pawls 36, 38.

Figure 7C:
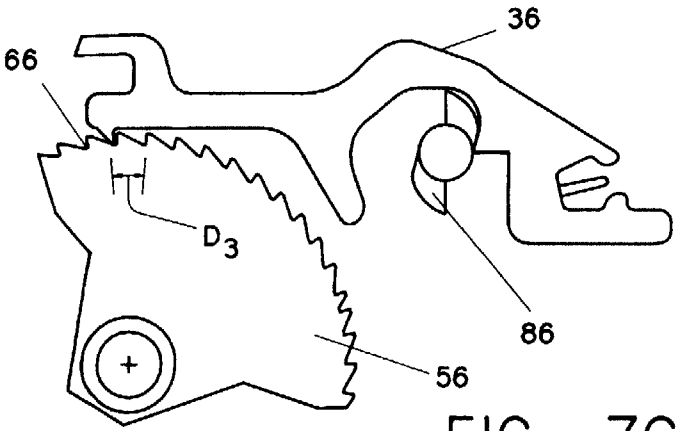

The drive cam 86 includes two 90° lobes separated by two 90° null spaces as shown in FIG. 7C. Hence, during a single 360° rotation of the drive cam 86, the fast pawl 36 is advanced through two complete strokes thereof. Each stroke of the fast pawl 36 includes a pull segment, a reset segment, and a pursue segment. During the pull segment, the fast pawl 36 pulls or otherwise urges a given ratchet tooth 66 in the general direction of arrow C of FIG. 6, thereby rotating the drive blade 56 and hence the program blades 70 in the same direction. More specifically, one of the lobes of the drive cam 86 causes the fast pawl 36 to be advanced through its pull segment during the period of time in which the drive shaft 80 rotates a distance of 90° . For example, if the drive shaft 80 is rotated at a speed of one revolution-per-minute, the drive cam 86 causes the fast pawl 86 to be advanced through its pull segment in fifteen seconds.

After the fast pawl 36 has pulled the given ratchet tooth 66 a predetermined distance, such as 7½°, thereby completing the pull segment, the fast pawl 36 begins the reset segment of its stroke. In the reset segment of its stroke, the fast pawl 36 is first urged in the general direction of arrow A of FIG. 6 thereby advancing the barb **36*a* along the inclined surface 63 of a subsequent ratchet tooth 66. More specifically, the spring 74 causes the barb 36*a* to be advanced along the inclined surface 63 in the general direction of arrow A of FIG. 6**.

During the reset segment, the barb **36*a* is advanced a distance $D_3$ as shown in FIG. 7C in order to allow the barb 36*a* to engage the engagement surface 67 of the ratchet teeth 66 despite any dimensional errors (e.g. manufacturing errors) and design tolerances that may be associated with the appliance timer 12. For example, if the engagement point 67** of a given ratchet tooth 66 is placed a distance of ½° further down the drive blade 56 by a manufacturing error, the barb 36a must be advanced a distance of an additional ½° beyond the engagement point 67. It should be appreciated that the magnitude of the distance $D_3$ may be varied so long as the barb 36a is advanced beyond the engagement point 67 despite a given range of dimensional errors and design tolerances associated with a given appliance timer 12. In particular, the barb 36a is advanced a distance ($D_3$) of 9° during the reset segment of the stroke of the fast pawl 36. Therefore, if the ratchet teeth 66 defined in the drive blade 56 are 7½° in size, the barb 36a is advanced a distance of 1½° beyond the engagement point 67 of the ratchet teeth 66.

After the fast pawl 36 completes the reset segment of its stroke, the fast pawl 36 begins the pursue segment of its stroke. In the pursue segment of its stroke, the fast pawl 36 is quickly advanced in the general direction of arrow B in FIG. 6. More specifically, when the fast pawl 36 completes the reset segment of its stroke, the configurations of the drive cam 86 and the cam aperture 36b then cause the slow pawl 36 and hence the barb 36a to be advanced in the general direction of arrow B in FIG. 6 at a speed which is greater in magnitude than the speed at which the fast pawl 36 is advanced during the pull segment of its stroke. The configurations of the drive cam 86 and the cam aperture 36b cause the fast pawl 36 to continue to be advanced at the increased speed until the barb 36a is urged into contact with the engagement surface 65 of the subsequent ratchet tooth 66. Once urged into contact with the engagement surface 65, the fast pawl 36 and hence the barb 36a decreases in speed and begins to pull the subsequent ratchet tooth 66. Therefore, the fast pawl 36 is returned to the pull segment of its stroke thereby completing one entire stroke thereof.

However, the subsequent ratchet tooth 66 may not be present on the drive blade 56. In particular, if it is desirable to drive the camstack with the slow pawls 32, 34 in the manner described above, the subsequent ratchet tooth 66 is removed from the drive blade 56. Therefore, as the fast pawl 36 is advanced through subsequent pull segments, reset segments, and pursue segments, the fast pawl 36 does not rotate the camstack 30.

Figure 7D:
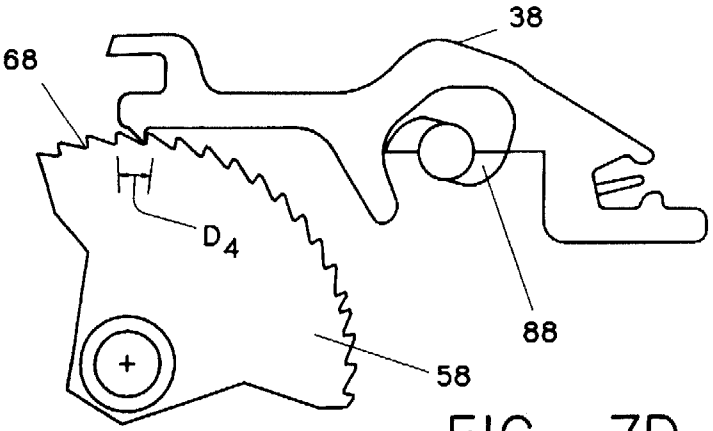

Similarly, the drive cam 88 includes two 90° lobes separated by two 90° null spaces as shown in FIG. 7D. Hence, during a single 360° rotation of the drive cam 88, the fast pawl 38 is advanced through two complete strokes thereof. Each stroke of the fast pawl 38 includes a pull segment and a reset segment. During the pull segment, the fast pawl 38 pulls or otherwise urges a given ratchet tooth 68 in the general direction of arrow C of FIG. 6, thereby rotating the drive blade 58 and hence the program blades 70 in the same direction. More specifically, one of the lobes of the drive cam 88 causes the fast pawl 38 to be advanced through its pull segment during the period of time in which the drive shaft 80 rotates a distance of 90°. For example, if the drive shaft 80 is rotated at a speed of one revolution-per-minute, the drive cam 88 causes the fast pawl 88 to be advanced through its pull segment in fifteen seconds.

After the fast pawl 38 has pulled the given ratchet tooth 68 a predetermined distance, such as 7½°, thereby completing the pull segment, the fast pawl 38 begins the reset segment of its stroke. In the reset segment of its stroke, the fast pawl 38 is first urged in the general direction of arrow A of FIG. 6 thereby advancing the barb 38a along the inclined surface 63 of a subsequent ratchet tooth 68. More specifically, the spring 74 causes the barb 38a to be advanced along the inclined surface 63 in the general direction of arrow A of FIG. 6.

During the reset segment, the barb 38a is advanced a distance $D_4$ as shown in FIG. 7D in order to allow the barb 38a to engage the engagement surface 67 of the ratchet teeth 68 despite any dimensional errors (e.g. manufacturing errors) and design tolerances that may be associated with the appliance timer 12. It should be appreciated that the distance $D_4$ is equal in magnitude to the distance $D_3$. As with the distance $D_3$, the distance $D_4$ may be varied so long as the barb 38a is advanced beyond the engagement point 67 despite a given range of dimensional errors and design tolerances associated with a given appliance timer 12. In particular, the barb 38a is advanced a distance ($D_4$) of 9° during the reset segment of the stroke of the fast pawl 38. Therefore, if the ratchet teeth 68 defined in the drive blade 58 are 7½° in size, the barb 38a is advanced a distance of 1½° beyond the engagement point 67 of the ratchet teeth 68.

After the fast pawl 38 completes the reset segment of its stroke, the fast pawl 38 begins the pursue segment of its stroke. In the pursue segment of its stroke, the fast pawl 38 is quickly advanced in the general direction of arrow B in FIG. 6. More specifically, when the fast pawl 38 completes the reset segment of its stroke, the configurations of the drive cam 88 and the cam aperture 38b then cause the slow pawl 38 and hence the barb 38a to be advanced in the general direction of arrow B in FIG. 6 at a speed which is greater in magnitude than the speed at which the fast pawl 38 is advanced during the pull segment of its stroke. The configurations of the drive cam 88 and the cam aperture 38b cause the fast pawl 38 to continue to be advanced at the increased speed until the barb 38a is urged into contact with the engagement surface 65 of the subsequent ratchet tooth 68. Once urged into contact with the engagement surface 65, the fast pawl 38 and hence the barb 38a decreases in speed and begins to pull the subsequent ratchet tooth 68. Therefore, the fast pawl 38 is returned to the pull segment of its stroke thereby completing one entire stroke thereof.

However, the subsequent ratchet tooth 68 may not be present on the drive blade 58. In particular, if it is desirable to drive the camstack with the slow pawls 32, 34 in the manner described above, the subsequent ratchet tooth 68 is removed from the drive blade 58. Therefore, as the fast pawl 38 is advanced through subsequent pull segments, reset segments, and pursue segments, the fast pawl 38 does not rotate the camstack 30.

The drive cams 86 and 88 are configured so as to be 180° out of phase. Therefore, as the fast pawl 36 is completing the pull segment of its stroke, the fast pawl 38 is beginning the pull segment of its stroke, and vice versa. In addition, the size of the ratchet teeth 66, 68 determines the distance which the camstack 30 is rotated during one complete stroke of fast pawls 36, 38. For example, the size of the ratchet teeth 66, 68 may be 7½° thereby causing the camstack 30 to be rotated a distance of 7½° during a single stroke of the fast pawls 36, 38. Therefore, since each of the fast pawls 36, 38 completes a single pull segment during a 90° rotation of the drive shaft 80, the fast pawls 36, 38 are each operated at a speed of two strokes-per-minute. Therefore, the camstack 30 is rotated at a net speed of thirty degrees-per-minute when being driven by the fast pawls 36, 38. Periods of time in which the fast pawls 36, 38 cooperate in order to provide for fast continuous rotation of the camstack 30 define a fast continuous mode of operation of the appliance timer 12. What is meant herein by the term "fast continuous mode" is a period of time in which the fast pawls 36, 38 cooperate in order to provide for continuous rotation of the camstack 30 at a speed which is greater in magnitude than the speed at which the slow pawls 32, 34 rotate the camstack 30.

In addition to pulling a given ratchet tooth 66 during the pull segment of its stroke, the fast pawl 36 also functions as a no-back pawl during the pull segment of its stroke thereby eliminating the need for a separate no-back pawl. More specifically, as the fast pawl 38 advances along the inclined surface 65 of the ratchet teeth 68 during the reset segment of its stroke, the bias of the spring 74 urges the ratchet teeth 68 and hence the drive blade 58 in the general direction of arrow D of FIG. 6. However, the force exerted on the engagement surface 65 of the ratchet teeth 66 during movement thereof by the barb 36*a* of the fast pawl 36 is of a greater magnitude than the bias created by the spring 74 thereby preventing the fast pawl 38, or any other forces which may be present, from rotating the drive blade 58 and hence the program blades 70 in the general direction of arrow D of FIG. 6. Similarly, the fast pawl 38 also functions as a no-back pawl when the fast pawl 38 is positioned in the pull segment of its stroke.

From the above discussion, it should be appreciated that the slow pawls 32, 34 cooperate in order to operate the appliance timer 12 in a slow continuous mode in which the camstack 30 is continuously rotated at a slow speed for a given period of time, whereas the fast pawls 36, 38 cooperate in order to operate the appliance timer 12 in a fast continuous mode in which the camstack 30 is continuously rotated at a fast speed for a given period of time. However, it may be desirable to advance the camstack 30 via slow interval or interrupted rotation during a given period of time in order to conserve cam space. Such periods of time in which the camstack 30 is advanced via slow interval rotation defines an interrupted mode of operation of the appliance timer 12.

In order to advance the camstack 30 via slow interval rotation, the ratchet teeth 66, 68 are removed from the drive blades 86, 88, respectively, and one or more of the ratchet teeth 64 are removed from the drive blade 54. In addition, the size of the ratchet teeth 62 defined in the drive blade 52 may be reduced in size in order to reduce the distance in which the camstack 30 is rotated during each stroke of the slow pawl 32 thereby conserving the amount of cam space that is utilized during each stroke of the slow pawl 32. For example, the ratchet teeth 62 may be 4½° in size.

The portion of the drive blade 54 from which the ratchet teeth are removed defines an interrupt gap 61 as shown in FIG. 3. The interrupt gap 61 is positioned in predetermined locations on the drive blade 54. When (1) the barb 34*a* of the slow pawl 34 is positioned within the interrupt gap 61, (2) the slow pawl 34 is positioned in the pull segment of its stroke, and (3) the slow pawl 32 is positioned in the reset segment of its stroke, then no rotation of the camstack 30 occurs. In operation, the slow pawl 34 is advanced through the same path of travel associated with its pull segment, reset segment, and pursue segment, but the slow pawl 34 does not rotate the drive blade 54. Upon further rotation of the camstack 30 by the slow pawl 32, the ratchet teeth 64 may then be positioned under the barb 34*a* so that the slow pawl 34 may rotate the camstack 30 in the manner previously described thereby returning the appliance timer 12 to its first mode of operation.

The appliance timer 12 further includes a pawl lifter 102 as shown in FIG. 3. The pawl lifter 102 is rotatably secured to the housing 16. In particular, an aperture 104 defined in the pawl lifter 102 is rotatably secured to a post 106 of the housing 16. The pawl lifter further includes a post 108 and an angled surface 110. The post 108 is received through a slot 32*c*, 34*c*, 36*c*, 38*c*respectively defined in each of the pawls 32, 34, 36, 38.

If the operator of the appliance 10 desires to manually set the appliance timer 12 and therefore pushes and turns the knob 26 (see FIG. 2), the control shaft 24 is urged in the general direction of arrow E of FIG. 3. As the control shaft 24 moves in the general direction of arrow E, the beveled end 24*b* thereof contacts the angled surface 110 of the pawl lifter 102 thereby urging the pawl lifter 102 and hence the post 108 in the general direction of arrow F of FIG. 6. Movement of the post 108 in the general direction of arrow F of FIG. 6 causes the pawls 32, 34, 36, 38 to be likewise urged in the general direction of arrow F thereby disengaging the barbs 32*a*, 34*a*, 36*a*, 38*a* from the ratchet teeth 62, 64, 66, 68, respectively. Therefore, as the operator of the appliance 10 turns or otherwise rotates the knob 26 in order to set the appliance timer 12, the pawls 32, 34, 36, 38 are spaced apart from the ratchet teeth 62, 64, 66, 68 thereby reducing noise associated with manually setting the appliance timer 12 and also permitting bidirectional setting of the knob 26.

In operation, the appliance timer 12 is switched between the various modes of operation thereof during predetermined periods of time within the entire operation cycle of the appliance 10. For example, once the appliance timer 12 has initiated an operation sub-cycle (e.g. the water draining cycle in the case of the clothes washing machine), the appliance timer 12 may be placed in the third mode of operation thereof in which cam space is conserved in the manner previously described. Thereafter, the appliance timer 12 may remain in the third mode of operation until the end of the operation sub-cycle (e.g. the water draining cycle), at which time the appliance timer 12 may be placed in the first or second mode of operation thereof in order to initiate subsequent operation sub-cycles (e.g. the rinse cycle and thereafter the spin cycle in the case of the clothes washing machine).

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A timer for controlling an appliance, comprising:

a motor having an output shaft;

a camstack; and a plurality of pawls each which are mechanically coupled to said output shaft of said motor, wherein said plurality of pawls includes a first pawl and a second pawl which cooperate to (1) continuously rotate said camstack when said timer is operated in a first mode of operation, and (2) interruptedly rotate said camstack when said timer is operated in a second mode of operation, wherein said first pawl and said second pawl are each advanced by said motor to contact said camstack and cause rotation thereof when said timer is operated in said first mode of operation, and wherein said first pawl only causes rotation of said camstack by being advanced into contact therewith by said motor when said timer is operated in said second mode of operation.

2. The timer of claim 1, wherein:

said camstack is rotated in a slow continuous mode during a first time segment when said timer is operated in said first mode of operation, and said camstack is rotated in a fast continuous mode during a second time segment when said timer is operated in said first mode of operation.

3. The timer of claim 1, wherein:

said camstack has a first group and a second group of ratchet teeth defined therein, said first pawl engages said first group of ratchet teeth so as to rotate said camstack during a first period of time, and said second pawl engages said second group of ratchet teeth so as to rotate said camstack during a second period of time.

4. The timer of claim 1, wherein:

said camstack is rotated at a first speed during said first period of time, said camstack is rotated at a second speed during said second period of time, and said first speed is approximately equal to said second speed.

5. The timer of claim 1, further comprising (1) a first cam which is mechanically interposed between said output shaft of said motor and said first pawl, and (2) a second cam which is mechanically interposed between said output shaft of said motor and said second pawl, wherein:

movement of said first cam causes movement of said first pawl in a first path of movement, and movement of said second cam causes movement of said second pawl in a second path of movement.

6. The timer of claim 5, further comprising a drive shaft which is mechanically coupled to said output shaft of said motor, wherein:

movement of said first cam and said second cam are caused by rotation of said drive shaft, and said first cam and said second cam are secured to said drive shaft so as to be 180° out of phase.

7. The timer of claim 6, wherein:

said first cam and said second cam are configured so as to be substantially similar in shape.

8. The timer of claim 5, wherein:

said first pawl has a first open aperture defined therein, said second pawl has a second open aperture defined therein, said first cam is positioned in said first open aperture, and said second cam is positioned in said second open aperture.

9. A timer for controlling an appliance, comprising:

a motor;

a plurality of pawls which are mechanically coupled to said motor, said plurality of pawls including a first slow pawl and a first fast pawl; and a camstack which is continuously rotated by said plurality of pawls during a portion of an entire operation cycle of said appliance, said camstack being rotated in either a slow mode of operation or a fast mode of operation, wherein (i) said first slow pawl is driven by said motor so as to be advanced in a first path of movement, and (ii) movement of said first slow pawl in said first path of movement causes said slow pawl to contact said camstack and rotate said camstack in said slow mode of operation; and wherein (i) said first fast pawl is driven by said motor so as to be advanced in a second path of movement, and (ii) movement of said first fast pawl in said second path of movement causes said fast pawl to contact said camstack and rotate said camstack in said fast mode of operation.

10. The timer of claim 9, wherein:

said plurality of pawls further includes a second slow pawl and a second fast pawl, said second slow pawl is driven by said motor so as to be advanced in a third path of movement, movement of said second slow pawl in said third path of movement causes said second slow pawl to contact said camstack and rotate said camstack in said slow mode of operation;

said second fast pawl is driven by said motor so as to be advanced in a fourth path of movement, and movement of said second fast pawl in said fourth path of movement causes said second fast pawl to contact said camstack and rotate said camstack in said fast mode of operation.

11. The timer of claim 10, wherein:

movement of said first slow pawl in said first path of movement and movement of said second slow pawl in said third path of movement causes said camstack to be continuously rotated in said slow mode of operation during said portion of said entire operation cycle of said appliance except for when said camstack is being rotated in said fast mode of operation.

12. The timer of claim 11, wherein:

movement of said first fast pawl in said second path of movement and movement of said second fast pawl in said fourth path of movement causes said camstack to be continuously rotated in said fast mode of operation during said portion of said entire operation cycle of said appliance except for when said camstack is being rotated in said slow mode of operation.

13. The timer of claim 12, further comprising (1) a first slow cam which is mechanically interposed between an output shaft of said motor and said first slow pawl, and (2) a second slow cam which is mechanically interposed between said output shaft of said motor and said second slow pawl, wherein:

movement of said first slow cam causes movement of said first slow pawl in said first path of movement, and movement of said second slow cam causes movement of said second slow pawl in said third path of movement.

14. The timer of claim 13, further comprising a drive shaft which is mechanically coupled to said output shaft of said motor, wherein:

movement of said first slow cam and said second slow cam are caused by rotation of said drive shaft, and said first slow cam and said second slow cam are secured to said drive shaft so as to be 180° out of phase.

15. The timer of claim 14, wherein:

said first slow cam and said second slow cam are configured so as to be substantially similar in shape.

16. The timer of claim 15, further comprising (1) a first fast cam which is mechanically interposed between an output shaft of said motor and said first fast pawl, and (2) a second fast cam which is mechanically interposed between said output shaft of said motor and said second fast pawl, wherein:

movement of said first fast cam causes movement of said first fast pawl in said second path of movement, and movement of said second fast cam causes movement of said second fast pawl in said fourth path of movement.

17. The timer of claim 16, wherein:

movement of said first fast cam and said second fast cam are caused by rotation of said drive shaft, and said first fast cam and said second fast cam are secured to said drive shaft so as to be 180° out of phase.

18. The timer of claim 17, wherein:

said first fast cam and said second fast cam are configured so as to be substantially similar in shape.

19. A method of controlling an appliance with a timer having a first pawl, a second pawl, and a camstack, comprising the steps of:

operating said first pawl and said second pawl so as to continuously rotate said camstack when said timer is operating in a first mode of operation; and operating said first pawl and said second pawl so as to interruptedly rotate said camstack when said timer is operating in a second mode of operation, wherein said continuously rotate operating step includes the steps of (1) advancing said first pawl into contact with said camstack to cause rotation thereof when said timer is operating in said first mode of operation, and (2) advancing said second pawl into contact with said camstack to cause rotation thereof when said timer is operating in said first mode of operation, and wherein said interruptedly rotate operating step includes the steps of (1) advancing said first pawl into contact with said camstack to cause rotation thereof when said timer is operating in said second mode of operation, and (2) advancing said second pawl in a manner which does not cause rotation of said camstack when said timer is operating in said second mode of operation.

20. The method of claim 19, wherein:

said camstack has a first group and a second group of ratchet teeth defined therein, said first mode first pawl advancing step includes the step of engaging said first pawl with said first group of ratchet teeth during a first period of time so as to rotate said camstack during said first period of time, and said first mode second pawl advancing step includes the step of engaging said second pawl with said second group of ratchet teeth during a second period of time so as to rotate said camstack during said second period of time.

21. The method of claim 20, wherein:

said camstack is rotated at a first speed during said first period of time, said camstack is rotated at a second speed during said second period of time, and said first speed is approximately equal to said second speed.

22. A timer for controlling an appliance, comprising:

a motor;

a camstack having a first drive blade and a second drive blade defined therein;

a first pawl which is moved by said motor so as to engage said first drive blade in order to rotate said camstack during a first period of time; and a second pawl which is moved by said motor so as to engage said second drive blade in order to rotate said camstack during a second period of time, wherein (1) said camstack is rotated at a first speed by said first pawl during said first period of time, (2) said camstack is rotated at a second speed by said second pawl during said second period of time, and (3) said first speed is approximately equal to said second speed.

23. The timer of claim 22, wherein:

said first drive blade has a first group of ratchet teeth defined therein, said second drive blade has a second group of ratchet teeth defined therein, said first pawl includes a first barb, said second pawl includes a second barb, said first barb of said first pawl engages said first group of ratchet teeth during said first period of time, and said second barb of said second pawl engages said second group of ratchet teeth during said second period of time.

24. The timer of claim 22, wherein:

said first drive blade has a group of ratchet teeth defined therein, said second drive blade has an interrupt gap defined therein, said first pawl includes a first barb, said second pawl includes a second barb, said first barb of said first pawl engages said group of ratchet teeth during said first period of time, and said second barb of said second pawl is positioned within said interrupt gap during a third period of time.

25. The timer of claim 22, further comprising (1) a first cam which is mechanically interposed between an output shaft of said motor and said first pawl, and (2) a second cam which is mechanically interposed between said output shaft of said motor and said second pawl, wherein:

movement of said first cam causes movement of said first pawl during said first period of time, and movement of said second cam causes movement of said second pawl during said second period of time.

26. The timer of claim 25, further comprising a drive shaft which is mechanically coupled to said output shaft of said motor, wherein:

movement of said first cam and said second cam are caused by rotation of said drive shaft, and said first cam and said second cam are secured to said drive shaft so as to be 180° out of phase.

* * * * *